US007520484B1

(12) United States Patent
Kamath et al.

(10) Patent No.: US 7,520,484 B1
(45) Date of Patent: Apr. 21, 2009

(54) DOCUMENT STAND

(76) Inventors: Sudhaker Kamath, 38 Huntclub Dr., Bloomsburg, PA (US) 17815; George Smith, 422 Main St., Jersey Shore, PA (US) 17740

( * ) Notice: Subject to any disclaimer, the term of this patent is extended or adjusted under 35 U.S.C. 154(b) by 392 days.

(21) Appl. No.: 10/907,347

(22) Filed: Mar. 30, 2005

Related U.S. Application Data

(60) Provisional application No. 60/521,325, filed on Apr. 1, 2004.

(51) Int. Cl.
*A47B 19/00* (2006.01)

(52) U.S. Cl. ..... 248/447; 248/444; 248/458

(58) Field of Classification Search ..... 248/447, 248/444, 458, 454, 444.1, 125.7, 125.8, 125.9, 248/457
See application file for complete search history.

(56) References Cited

U.S. PATENT DOCUMENTS 1,253,568 A * 1/1918 Bartlett ..... 248/447
2,743,550 A * 5/1956 Felice ..... 248/457
3,408,032 A * 10/1968 Francis ..... 248/450
4,781,355 A * 11/1988 Jeantin ..... 248/441.1
5,624,096 A * 4/1997 Haynes ..... 248/451
6,802,486 B2 * 10/2004 Weingartner ..... 248/454

* cited by examiner

*Primary Examiner*—Korie Chan
*Assistant Examiner*—Steven Marsh
(74) *Attorney, Agent, or Firm*—John J. Elnitski, Jr.

(57) ABSTRACT

A document stand including a base and a post attached to the base. The document stand includes two document supports. Each of the document supports includes a top end, bottom end and two sides. Each of the document supports includes an upper surface and a lower surface, wherein the upper surface and the lower surface of each of the document supports are defined by the top end, bottom end and sides of the document supports. There is a rotational body rotatably mounted in the post. The rotational body includes two sides which can be accessed on either side of the post The two document supports are mounted to the rotational body with one of the two document supports on each side of the rotational body and therefore either side of the post. The two document supports can be rotated in relation to the post by rotation of the rotational body.

7 Claims, 7 Drawing Sheets

DOCUMENT STAND

BACKGROUND

The present invention generally relates to document stands. More specifically, the present invention relates to adjustable document stands to hold books.

There are document stands on the market. Many of them hold a book by the spine and can not be rotated about a base. The current document stands on the market lack adjustability to hold a book at the correct angle to support the book in an open position, while having the book at a correct angel for reading. The correct angle to support a book can be different depending on the location of where the document stand is placed and the position of the reader of the book in relation to document stand.

It is an object of the present invention to provide a document stand to hold a book by the whole book and not the spine.

It is another object of the present invention to provide a document stand with adjustable features to adapt for the location the document stand is to be placed.

SUMMARY OF THE INVENTION

A document stand including a base and a post attached to the base. The document stand includes two document supports for supporting a document. Each of the document supports includes a top end, bottom end and two sides. Each of the document supports includes an upper surface and a lower surface, wherein the upper surface and the lower surface of each of the document supports are defined by the top end, bottom end and sides of the document supports. There is a rotational body rotatably mounted in the post. The rotational body includes two sides which can be accessed on either side of the post The two document supports are mounted to the rotational body with one of the two document supports on each side of the rotational body and therefore either side of the post. The two document supports can be rotated in relation to the post by rotation of the rotational body.

DETAILED DESCRIPTION

Figure 5:
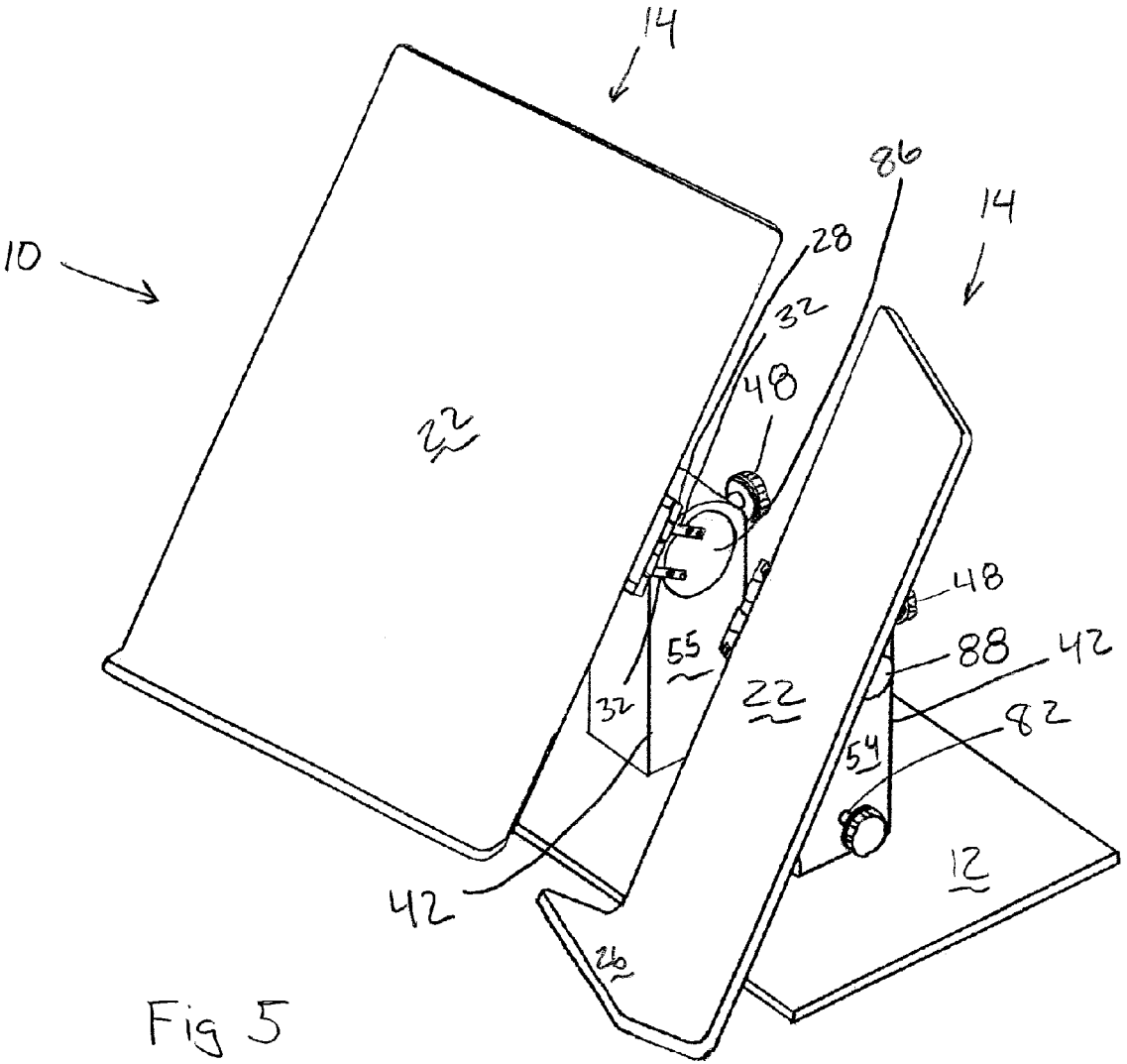
FIG. 5 is a front perspective view of a document stand according to the present invention.
Figure 6:
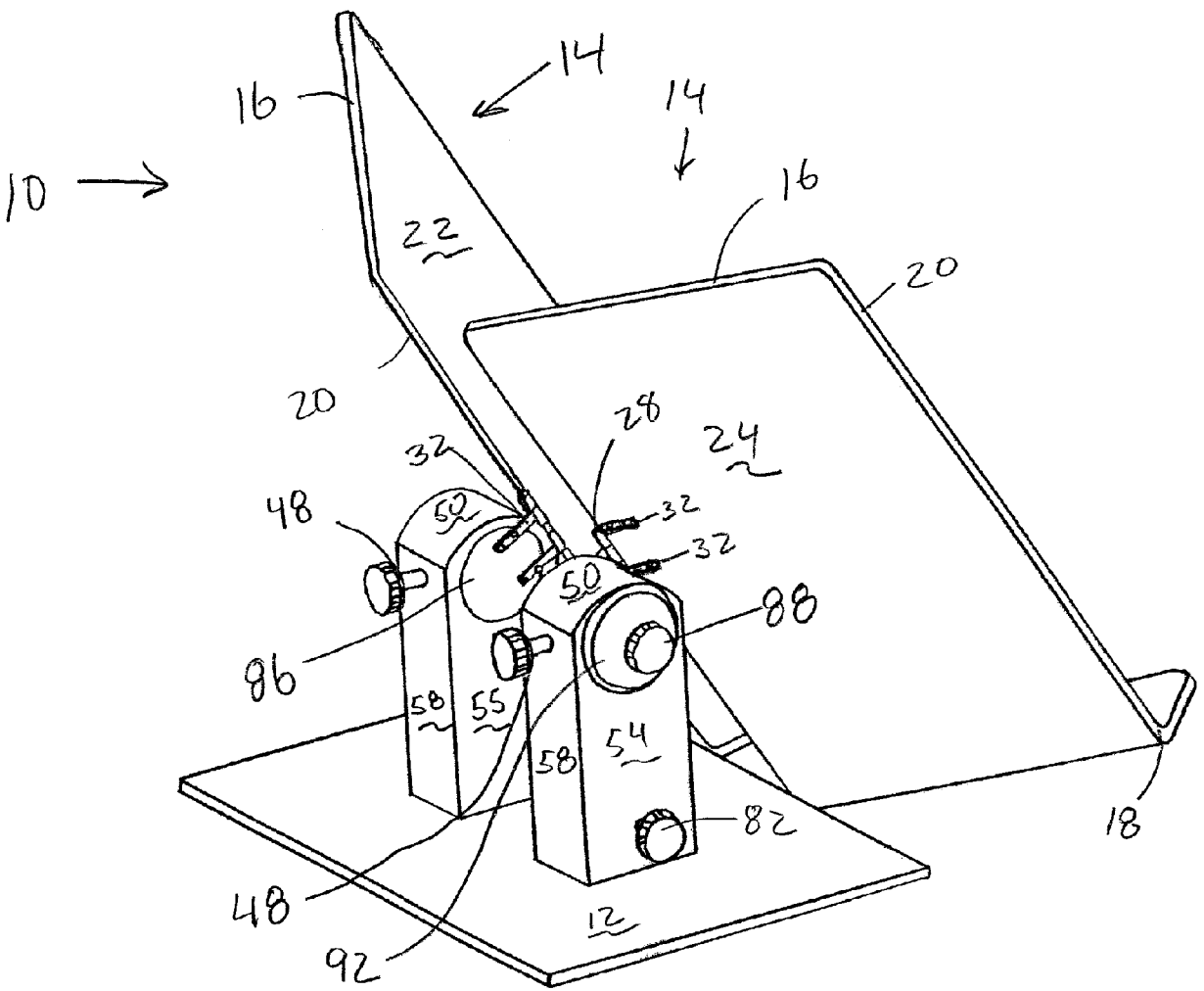
FIG. 6 is a rear perspective view of a document stand according to the present invention.
Figure 7:
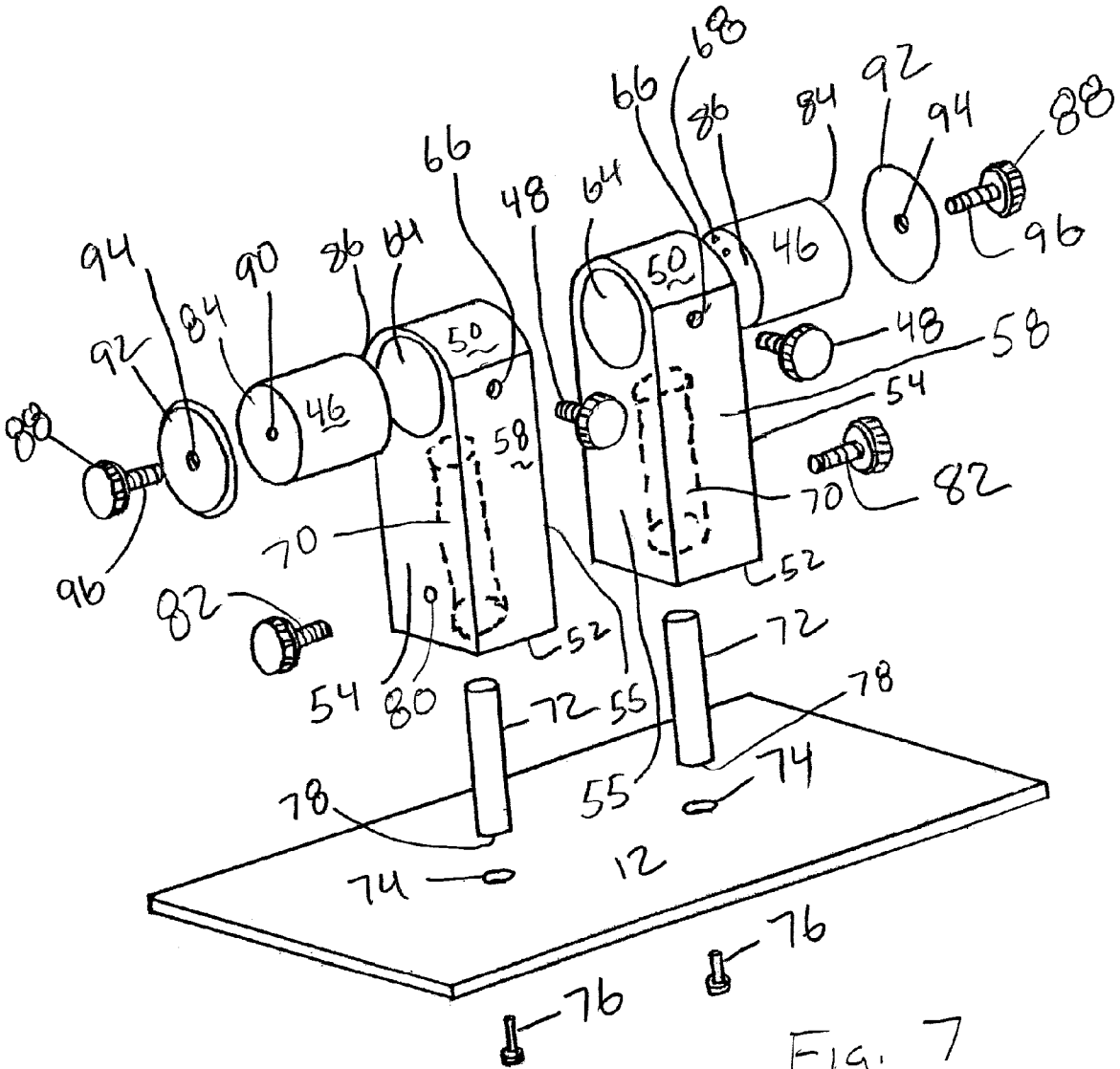
FIG. 7 is an exploded view of a document stand according to the present invention.

The present invention is a document stand 10, as shown in FIGS. 1-7. FIGS. 1-4 show a single post embodiment. FIGS. 5-7 show a double post embodiment. All embodiments of the document stand 10 include a base 12 and two document supports 14. The document supports 14 are flat rectangles with a top end 16, bottom end 18 and two sides 20. The document support 14 includes an upper surface 22 and a lower surface 24. The upper surface 22 and lower surface 24 are defined by the top end 16, bottom end 18 and sides 20 of the document support 14. The document supports 14 are preferably made of a clear see-thru material. The bottom end 18 includes a document retainer 26 extending outward from the bottom end 18 in a perpendicular manner.

Each document support 14 is shown to include a hinge 28 extending from the lower surface 24 at one of the sides 20 of the document support 14. The hinges 28 are shown to include four open ended hollow cylinders 30. Each cylinder 30 includes an attachment leg 32. Each attachment leg 32 includes two screw holes 34. The hinges 28 each include a hinge pin 36 to secure the four cylinders 30 together by placing the hinge pin 36 in the hollow cylinders 30. Two of the attachment legs 32 are screwed to the lower surface 24 of the document support 14. The attachment legs 32 attached to the lower surface 24 using screws 38 and screw holes 34 of the attachment legs 32. The screws 38 are screwed into screw holes 40 located on the lower surface 24 of the document support 14. The hinges 28 are preferably of a friction type, which require an amount of force to rotate something about the hinge and resist gravitational forces due to weight on the document supports 14.

FIGS. 1-4 show an embodiment with one post 42. The post 42 includes a main body 44, rotation cylinder 46 and an angle set screw 48. The main body 44 includes a top 50, a bottom 52, two sides 54, front 56 and a back 58. The main body 44 is attached to the base 12. The base 12 includes a fastener hole 60 to allow passage of a fastener 62. The main body 44 is attached to the base 12 using the fastener 62 which screws into the bottom 52 of the main body 44. The fastener 62 can be tighten in such a way to allow rotation of the main body 44 about the base 12. The main body 44 includes a through hole 64 near the top 50 of the main body 44. The main body 44 includes an angle set screw hole 66 to receive the angle set screw 48. The angle set screw hole 66 is shown positioned at the back 58 of the main body 44 in the area of the through hole 64 of the main body 44. The angle set screw hole 66 leads from the back 58 of the main body 44 into the through hole 64 of the main body 44.

The rotational cylinder 46 includes two ends 47 which have a circular diameter and a length between the two ends 47. The rotational cylinder 46 has a diameter slightly less than the diameter of the through hole 64 of the main body 44. The length of the rotational cylinder 46 is usually about the thickness of the main body 44 between the sides 54 of the main body 44, such that ends of the rotational cylinder 46 can be accessed on either side 54 of the main body 44. The rotational cylinder 46 fits into the through hole 64 of the main body 44 and acts as a rotational body. The rotational cylinder 46 is rotatable in the through hole 64 of the main body 44. The rotational cylinder 46 fits snuggly into the through hole 64 of the main body 44, so that an amount of force is required to overcome the frictional force between the material of the rotational cylinder 46 and the main body 44. An ideal material for the rotational cylinder 46 and the main body 44 is a nylon type of material. An important feature of the use of nylon is that the nylon material absorbs static electricity, therefore making it easier to turn pages of a document without the pages sticking together due to static electricity. So, a static electricity absorbing material is preferable for the main body 44, rotational cylinder 46 and other parts of the document stand 10.

The angle set screw 48 is used to lock the rotational cylinder 46 in position and prevent the rotational cylinder 46 from rotating. The angle set screw 48 is screwed into the angle set screw hole 66 and against the rotational cylinder 46 to accomplished the task of locking the rotational cylinder 46 in position. The other two attachment legs 32 of the hinges 28 are attached to the ends 47 of the rotational cylinder 46 using screw holes 34 of the attachment legs 32, screws 38 and screw holes 68 in the ends 48 of the rotational cylinder 46. Attachment of the hinges 28 to the rotational cylinder 46 provides a mounting point for each of the document supports 14 to the post 41.

A document such as a book can be placed opened on the document supports 14 of the embodiment shown in FIGS. 1-4. The document retainers 26 of each document support 14 prevent a book or other documents from sliding off of the document supports 14. The hinges 28 employed are frictional type hinges which require an amount of force to rotate the document supports 14 about the hinges 28 and can hold the weight of a book without moving. The document supports 14 can be rotated about the hinges 28 to provide the proper angle for reading a document and keeping a document such as a book open. Together, the document supports 14 can be rotated about the through hole 64 of the main body 44 by rotating the rotational cylinder 46. Rotation of the rotational cylinder 46 provides the proper angle of the document supports 14 for reading a document in relation to the reader's position in front of the document stand 10. The angle set screw 48 is used as a stop to lock the angle of the document supports 14 by locking the rotational cylinder 46 in position. Also, as stated before, the post 42 can be rotated about the base 12 to adjust for the readers position.

FIGS. 5-7 show an embodiment with two posts 42. Each post 42 includes a main body 44, rotation cylinder 46 and an angle set screw 48. The main body 44 includes a top 50, a bottom 52, an outside side 54, inside side 55, front 56 and a back 58. The main body 44 includes a post cavity 70 leading from the bottom 52 of the main body 44 on into the main body 44. The base 12 includes two secondary posts 72 extending upward from the base 12. The base 12 includes two fastener holes 74 to allow passage of fasteners 76. Each secondary post 72 is attached to the base 12 using one of the fasteners 76 which screws into a bottom 78 of one of the secondary posts 72. Each main body 44 is mounted to the base 12 by sliding the main body 44 over one of the secondary posts 72. Whereby, the post cavity 70 of each of the main body 44 receives one of the secondary posts 72. The main body 44 includes a post screw hole 80 on the outside side 54, which leads to the post cavity 70 of the main body 44. The main body 44 is secured to the base 12 by screwing a post screw 82 into the post screw hole 80 and against one of the secondary posts 72. Each main body 44 includes a through hole 64 near the top 50 of the main body 44. Each main body 44 includes an angle set screw hole 66 to receive the angle set screw 48. The angle set screw hole 66 is shown positioned at the back 58 of the main body 44 in the area of the through hole 64 of the main body 44. The angle set screw hole 66 leads from the back 58 of the main body 44 into the through hole 64 of the main body 44.

Each rotational cylinder 46 includes an outside end 84 and an inside end 86, which have a circular diameter and includes a length between the outside end 84 and the inside end 86. Each rotational cylinder 46 has a diameter slightly less than the diameter of the through hole 64 of the main body 44 and acts as a rotational body. The length of each rotational cylinder 46 is usually about the thickness of the main body 44 between the outside side 54 and the inside side 55 of the main body 44, such that outside and inside ends 84, 86 of the rotational cylinder 46 can be accessed on either side of the main body 44. The rotational cylinder 46 fits into the through hole 64 of the main body 44. The rotational cylinder 46 is rotatable in the through hole 64 of the main body 44. The rotational cylinder 46 fits snuggly into the through hole 64 of the main body 44, so that an amount of force is required to overcome the frictional force between the material of the rotational cylinder 46 and the main body 44. An ideal material for the rotational cylinder 46 and the main body 44 is a nylon type of material. An important feature of the use of nylon is that the nylon material absorbs static electricity, therefore making it easier to turn pages of a document without the pages sticking together due to static electricity. So, a static electricity absorbing material is preferable for the main body 44, rotational cylinder 46 and other parts of the document stand 10. The outside end 84 of each rotational cylinder 46 includes a turn knob 88, a turn knob screw hole 90 and a washer 92. The washer 92 is larger in diameter than the through hole 64 of the main body 44 and includes a screw hole 94. The washer 92 prevents the rotational cylinder 46 from being pulled out of the through hole 64 from the inside side 55 of the main body 44. The turn knob 88 includes a knob screw 96 extending from the turn knob 88. The turn knob 88 is attached to the rotational cylinder 46 by inserting the knob screw 96 into the screw hole 94 of the washer 92 and then screwing the knob screw 96 into the turn knob screw hole 90 of the rotational cylinder 46.

Figure 1:
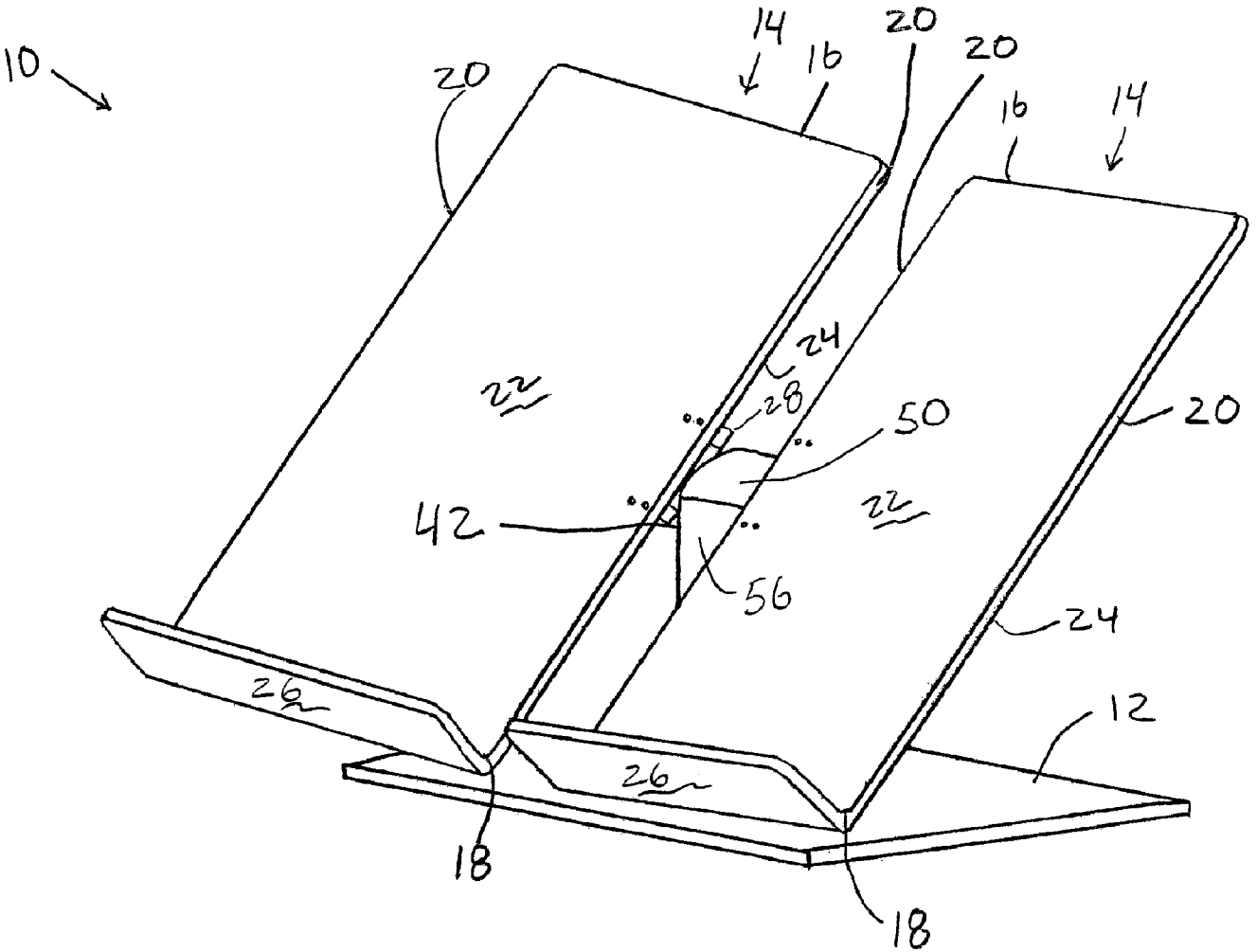
FIG. 1 is a front perspective view of a document stand according to the present invention.
Figure 2:
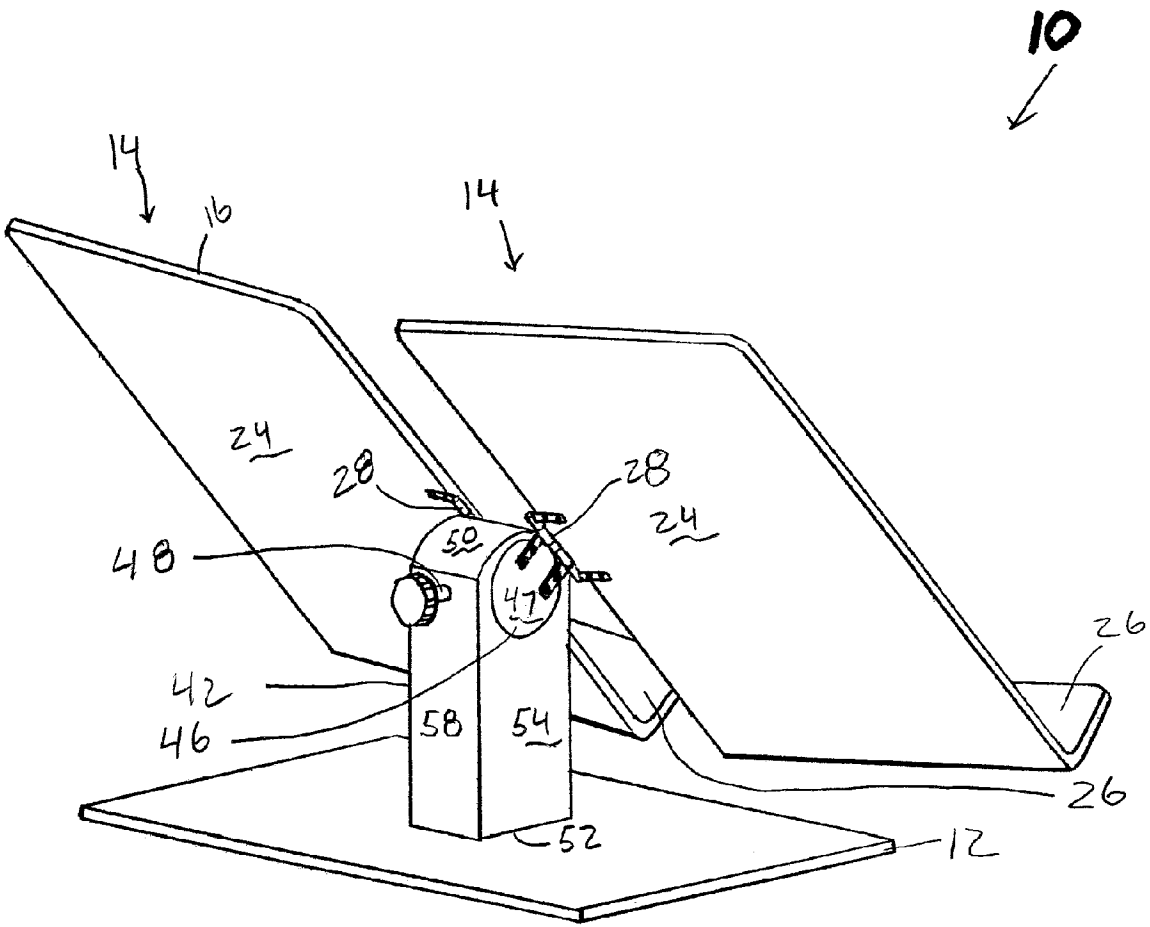
FIG. 2 is a rear perspective view of a document stand according to the present invention.
Figure 3:
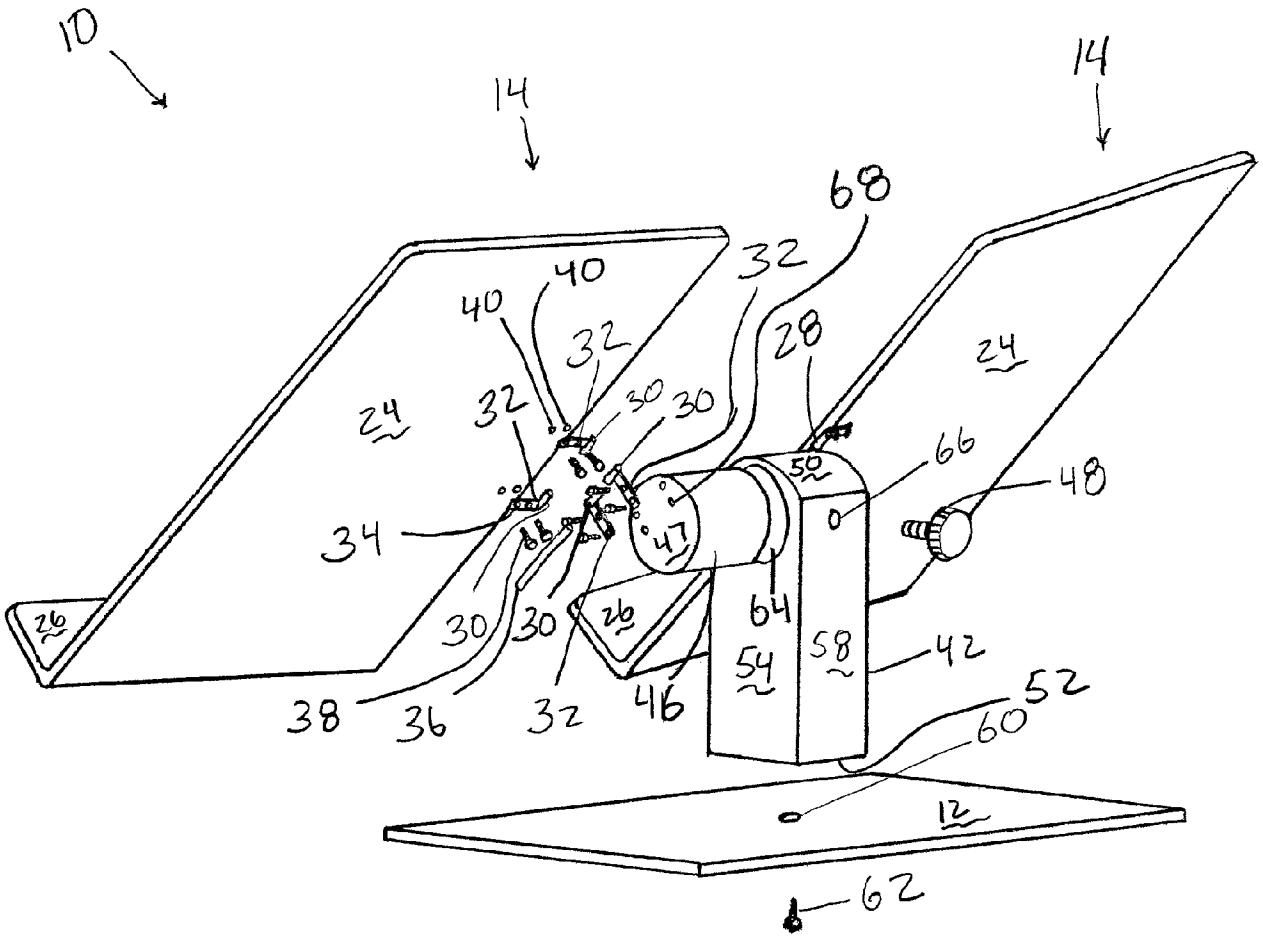
FIG. 3 is a rear partial exploded perspective view of a document stand according to the present invention.
Figure 4:
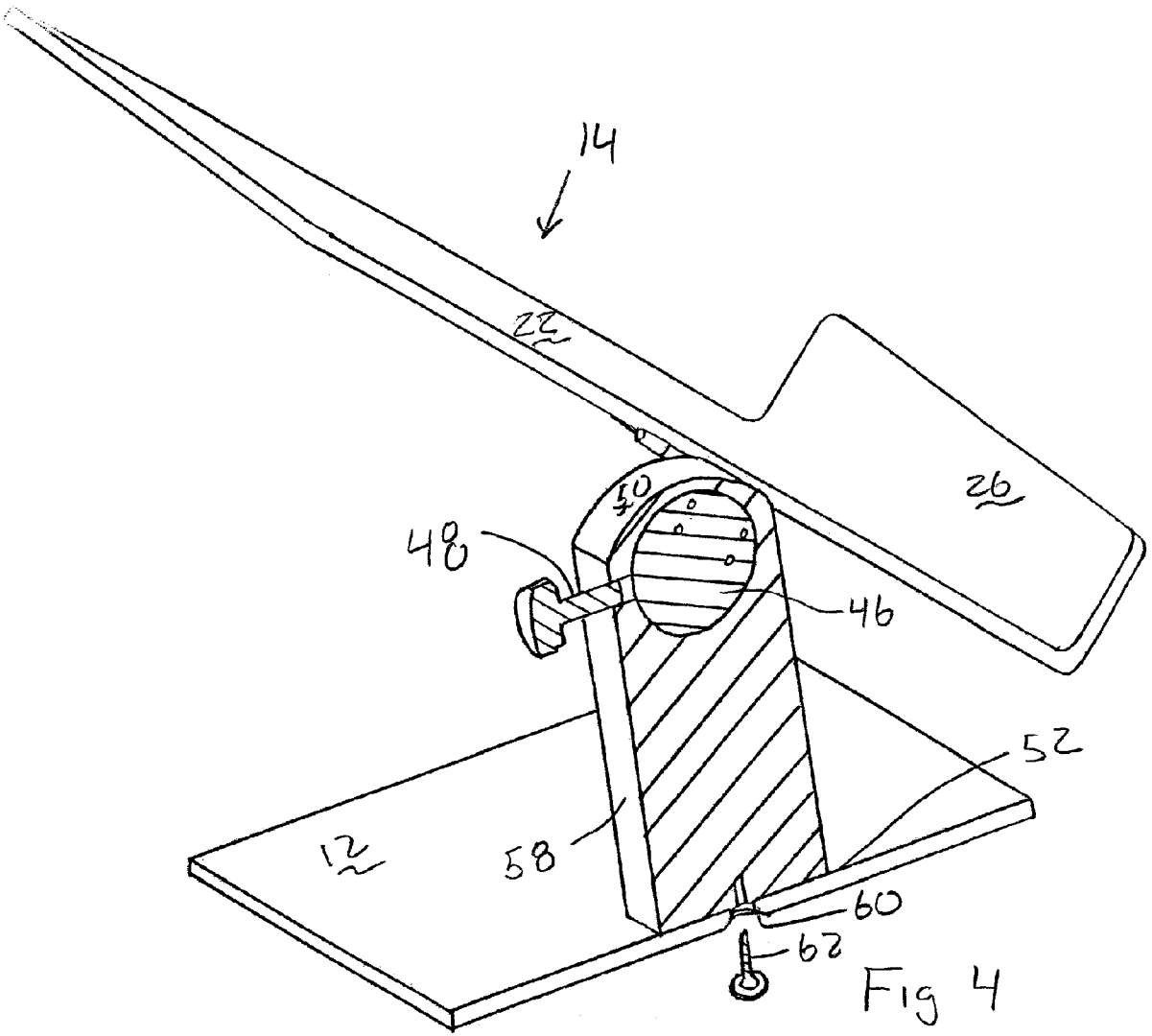
FIG. 4 is a partial sectional perspective view of a document stand according to the present invention.

Each angle set screw 48 is used to lock each rotational cylinder 46 in position and prevent each rotational cylinder 46 from rotating. The angle set screw 48 is screwed into the angle set screw hole 66 and against the rotational cylinder 46 to accomplished the task of locking the rotational cylinder 46 in position. The other two attachment legs 32 of the hinges 28 of each document support 14 are attached to the inside end 86 of one of the rotational cylinders 46. The attachment legs are mounted using screw holes 34 of the attachment legs 32, screws 38 and screw holes 68 in the rotational cylinder 46, as shown in FIG. 3 for the one post embodiment. Attachment of the hinges 28 to the rotational cylinders 46 provides a mounting point for each of the document supports 14 to each of the posts 42.

A document such as a book can be placed on the document supports 14 of the embodiment shown in FIGS. 5-6 in an open position. The document retainers 26 of each document support 14 prevent a book or other documents from sliding off of the document supports 14. The hinges 28 employed are frictional type hinges which require an amount of force to rotate the document supports 14 about the hinges 28 and can hold the weight of a book without moving. The document supports 14 can be rotated about the hinges 28 to provide the proper angle for reading a document and keeping a document such as a book open. Individually, the document supports 14 can be rotated about the through hole 64 of each main body 44 by rotating turn knob 88 attached to the rotational cylinder 46. Rotation of the rotational cylinder 46 rotates the document support 14 and provides the proper angle of the document supports 14 for reading a document in relation to the reader's position in front of the document stand 10. The angle set screw 48 is used to lock the angle of the document supports 14 by locking the rotational cylinder 46 in position. The position of each post 42 can be adjusted as to height above the base 12 and rotation about the base 12. Each post 42 can be positioned rotationally about the base 12, by rotating the post 42 about the secondary post 72. Each post 42 can be positioned at different heights above the base 12, by raising the post 42 up the secondary post 72 and using the post screw 82 to lock the post 42 in a position along the secondary post 72 and above the base 12. Also, all of the components described for the posts 42 in the embodiment of two posts can be employed with the embodiment with one post.

While different embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention that is to be given the full breadth of any and all equivalents thereof.

What is claimed is:

1. A document stand, comprising:

a base;

a post attached to said base, said post extending upward from said base;

two document supports for supporting a document, each of said document supports including a top end, bottom end and two sides, each of said document supports including an upper surface and a lower surface, wherein said upper surface and said lower surface of each of said document supports are defined by said top end, bottom end and sides of said document supports;

a rotational body rotatably mounted in said post; wherein said rotational body includes two sides which can be accessed on either side of said post; wherein said two document supports are mounted to said rotational body with one of said two document supports on each side of said rotational body and therefore either side of said post; and wherein said two document supports can be rotated in relation to said post by rotation of said rotational body: and a hinge attached between each of said document supports and said rotational body.

2. The document stand of claim 1, wherein said hinges are of a type which resist gravitation forces due to weight on said document supports.

3. The document stand of claim 1, further including a stop to lock said rotational body from rotating.

4. A document stand, comprising:

a base;

a post attached to said base, said post extending upward from said base;

two document supports for supporting a document, each of said document supports including a top end, bottom end and two sides, each of said document supports including an upper surface and a lower surface, wherein said upper surface and said lower surface of each of said document supports are defined by said top end, bottom end and sides of said document supports;

a rotational body rotatably mounted in said post; wherein said rotational body includes two sides which can be accessed on either side of said post; wherein said two document supports are mounted to said rotational body with one of said two document supports on each side of said rotational body and therefore either side of said post; and wherein said two document supports can be rotated in relation to said post by rotation of said rotational body: and wherein all components of said document stand are made from materials to absorb and conduct static electricity away from a document resting on said document stand.

5. A document stand, comprising:

a base;

a post attached to said base, said post extending upward from said base;

two document supports for supporting a document, each of said document supports including a top end, bottom end and two sides, each of said document supports including an upper surface and a lower surface, wherein said upper surface and said lower surface of each of said document supports are defined by said top end, bottom end and sides of said document supports;

a rotational body rotatably mounted in said post; wherein said rotational body includes two sides which can be accessed on either side of said post; wherein said two document supports are mounted to said rotational body with one of said two document supports on each side of said rotational body and therefore either side of said post; and wherein said two document supports can be rotated in relation to said post by rotation of said rotational body;

wherein said post includes a through hole in said post from side to side of said post; and wherein said rotational body is a cylinder having ends with a diameter less than a diameter of said through hole in said post such that said cylinder fits into said through hole in said post and rotates in said through hole in said post; and wherein said post includes a screw hole which leads to said through hole in said post and a screw to be screwed into said screw hole of said post to contact and prevent rotation of said cylinder.

6. A document stand, comprising:

a base;

a post attached to said base, said post extending upward from said base;

two document supports for supporting a document, each of said document supports including a top end, bottom end and two sides, each of said document supports including an upper surface and a lower surface, wherein said upper surface and said lower surface of each of said document supports are defined by said top end, bottom end and sides of said document supports;

a rotational body rotatably mounted in said post; wherein said rotational body includes two sides which can be accessed on either side of said post; wherein said two document supports are mounted to said rotational body with one of said two document supports on each side of said rotational body and therefore either side of said post; and wherein said two document supports can be rotated in relation to said post by rotation of said rotational body;

wherein said post includes a through hole in said post from side to side of said post; and wherein said rotational body is a cylinder having ends with a diameter less than a diameter of said through hole in said post such that said cylinder fits into said through hole in said post and rotates in said through hole in said post; and a hinge attached between each of said document supports and said cylinder.

7. The document stand of claim 6, wherein said hinges are of a type which resist gravitation forces due to weight on said document supports.

* * * * *